US007048816B2

(12) United States Patent
Verma et al.

(10) Patent No.: US 7,048,816 B2
(45) Date of Patent: May 23, 2006

(54) CONTINUOUSLY CAST MAGNESIUM CONTAINING, ALUMINUM ALLOY SHEET WITH COPPER ADDITION

(75) Inventors: Ravi Verma, Shelby Township, MI (US); Sooho Kim, Troy, MI (US)

(73) Assignee: General Motors Corporation, Detroit, MI (US)

( * ) Notice: Subject to any disclaimer, the term of this patent is extended or adjusted under 35 U.S.C. 154(b) by 128 days.

(21) Appl. No.: 10/716,370

(22) Filed: Nov. 18, 2003

(65) Prior Publication Data

US 2004/0129353 A1 Jul. 8, 2004

Related U.S. Application Data

(63) Continuation-in-part of application No. 10/273,432, filed on Oct. 17, 2002, now Pat. No. 6,811,625.

(51) Int. Cl.
*C22F 1/047* (2006.01)

(52) U.S. Cl. ..... 148/551; 148/552; 148/691; 148/692; 148/696

(58) Field of Classification Search ..... 148/551, 148/552, 691, 692, 696
See application file for complete search history.

(56) References Cited

U.S. PATENT DOCUMENTS

| | | | | |
|---|---|---|---|---|
| 4,531,977 | A | 7/1985 | Mishima et al. | |
| 4,619,712 | A | 10/1986 | Miyamoto et al. | |
| 5,540,791 | A | 7/1996 | Matsuo et al. | |
| 6,280,543 | B1 * | 8/2001 | Zonker et al. | 148/551 |

FOREIGN PATENT DOCUMENTS

| | | |
|---|---|---|
| JP | 57152453 | 9/1982 |

* cited by examiner

*Primary Examiner*—George Wyszomierski
*Assistant Examiner*—Janelle Morillo
(74) *Attorney, Agent, or Firm*—Kathryn A. Marra

(57) ABSTRACT

A magnesium, manganese and copper-containing aluminum alloy sheet material suitable for use in high elongation forming processes is produced according to an improved thermomechanical process. The sheet material is produced by continuous casting with an as-cast gage of 5 to 35 millimeters and immediately hot rolling with a final strip exit temperature between 200° C. and 350° C. and then coiling. The hot rolled coil is annealed at 450–560° C. to homogenize the microstructure. After cooling to ambient temperature, the coil is cold rolled to desired sheet thickness with a net gage reduction of 50–90 %. After suitable recrystallization of the cold worked microstructure the sheet is ready for hot, high elongation forming.

10 Claims, No Drawings

CONTINUOUSLY CAST MAGNESIUM CONTAINING, ALUMINUM ALLOY SHEET WITH COPPER ADDITION

CROSS-REFERENCE TO RELATED APPLICATION

This application is a continuation-in-part of patent application Ser. No. 10/273,432, filed Oct. 17, 2002 now U.S. Pat. No. 6,811,625 and assigned to the assignee of this invention.

TECHNICAL FIELD

This invention pertains to a thermomechanically processed, continuously cast aluminum alloy sheet suitable for use in high elongation sheet metal forming operations. More specifically, this invention pertains to a magnesium, manganese and copper-containing aluminum alloy, continuously cast and processed using a specific sequence of hot rolling, coiling, annealing and cold rolling operations to make a highly formable aluminum alloy sheet.

BACKGROUND OF THE INVENTION

Body panels for automotive vehicles are currently being manufactured using a superplastic (high elongation) forming process applied to certain manganese-containing and magnesium-containing aluminum alloy sheet stock. At the present time, the sheet stock is a specially prepared, fine grain microstructure aluminum alloy 5083. AA5083 has a nominal composition, by weight, of about 4 to 5 percent magnesium, 0.4 to 1 percent manganese, a maximum of 0.25 percent chromium, up to about 0.1 percent copper, up to about 0.4 percent iron, up to about 0.4 percent silicon, and the balance substantially all aluminum. Copper, iron and silicon are present as difficult to eliminate impurities.

Generally, the alloy is chill cast into a large ingot about 700 millimeters in thickness and subjected to a long homogenizing heat treatment. The slab is then gradually reduced in thickness by a series of hot rolling operations to a strip in the range of four to eight millimeters, depending somewhat on the goal for the final thickness of the sheet, and coiled. The coiled strip is then heavily cold rolled, usually in stages with possible interposed anneals, to a final sheet thickness in the range of about one to three or four millimeters.

The result of the thermomechanical processing is a coil of smooth surface aluminum sheet stock, the microstructure of which has been severely strained. The sheet material is heated to recrystallize it to a strain relieved, fine grain microstructure (grains less than about ten micrometers) and to a suitable forming temperature, e.g., 450 C to 500 C. In this condition a sheet blank can be stretch formed into an article of complex shape with regions of high biaxial stretching.

While this specially processed AA5083 type material is very useful for making articles such as automobile body panels it is much more expensive than the heavier carbon steel sheet which has long been used in the same applications. The above identified United States patent application describes a more efficient casting and thermomechanical processing method of making sheet material of magnesium containing aluminum alloy for sheet metal forming. The disclosed method comprises continuously casting such aluminum alloy compositions to form a cast slab. The cast slab is hot rolled, coiled, annealed and cold rolled. After recrystallization the sheet material is readily formable by hot stretch forming processes. The entire disclosure of the above identified application is incorporated by reference into this application.

It is an object of this invention to modify the composition of the above described magnesium containing aluminum alloys with the addition of copper to provide a continuously cast alloy processed as described in the application to a sheet material with higher formability than the Mg containing alloys that have contained minimal amounts of copper as an impurity.

SUMMARY OF THE INVENTION

The practice of this invention is particularly applicable to aluminum alloys consisting essentially of, by weight, 3.5% to 5.5% magnesium, 0.4% to 1.6% manganese, 0.05% to 0.5% chromium, 0.2% to 2.0% copper and the balance substantially all aluminum. The alloy has typical levels of unavoidable impurities such as iron and silicon, and incidental elements (added as grain refiners) such as titanium, boron, beryllium and zirconium. It is preferred that the alloys contain, by weight, 4.5% to 5.0% magnesium and 0.5% to 1.0% manganese, 0.05% to 0.3% chromium, 0 to 0.2% zirconium, and 0.5% to 1% copper.

A molten alloy of such composition is cast in a continuous caster to an as-cast gage of about 5 to 35 millimeters. There are a variety of suitable commercially available continuous casters for aluminum alloys. They include twin belt casters, twin roll casters and block type casters. The fast cooling rates inherent in continuous casting ensure that in addition to magnesium and copper, most of the other solute elements also remain in supersaturated solid solution. The hot cast slab is immediately passed through a one to three stand hot rolling mill placed in tandem with the caster to reduce the thickness of the slab and break up the as-cast dendritic microstructure. The rolling temperatures and the reduction levels in the hot rolling mill are managed such that the final hot rolled strip exit temperature is between 200° C. and 350° C., preferably between 230° C. and 330° C. This temperature range assures retention of some work strain in the metal. The net gage reduction from the cast slab to the rolled strip is in the range of 30 to 80% and the thickness of the hot rolled strip is between 3 and 10 millimeters or so, the maximum thickness that can be effectively coiled. Preferably, the strip is coiled as it emerges from the last rolling stand.

The coiled, hot rolled strip is annealed at 450° C. to 560° C. for 3 to 30 hours. Typically, the annealing step can be carried out at 500° C. to 550° C. for 5 to 15 hours to homogenize the microstructure of the cast and hot rolled strip and promote precipitation from aluminum solid solution of solute elements manganese, chromium, zirconium, copper and trace elements in the form of small, dispersed intermetallic particles. These particles serve a useful function in the final processing of the sheet material. The homogenization is, of course, completed more quickly at the higher temperatures. Following annealing the coil is cooled to ambient temperature for cold rolling.

The coil is subjected to one or more passes through a cold rolling stand to effect a cold reduction of the thickness of the strip by at least 50% and preferably 50 to 90%. Suitably, the cold rolled material is not annealed between rolling stages if more than one stage is used. The product of cold rolling is a severely worked cold rolled sheet of desired thickness for a high elongation sheet metal forming process. The sheet will typically have a thickness of about 1 to 3 mm for hot stretch forming into an automobile body panel or the like.

The surface of the cold rolled material is usually smooth and defect free for commercially acceptable visual appearance in formed articles. The sheet is usually coiled as it leaves the cold rolling mill.

The cold rolled sheet is hard and must be recrystallized to obtain a stress relieved, fine-grain sheet microstructure that can sustain superplasticity. Recrystallization can be done as a separate recrystallization anneal step or can simply occur during the heating stage for superplastic forming. During the recrystallization anneal step, the highly strained as-cold rolled microstructure provides a favorable thermodynamic driving force for recrystallization and the intermetallic particles formed during the homogenization anneal of the hot rolled coil provide nucleation sites for new grains during the recrystallization anneal step. Suitable recrystallization occurs within a few minutes when the cold worked coil is heated at 325° C. to 525° C. The recrystallization step may be conducted on the full coil or on sheet metal blanks removed from the coil for heating to a suitable forming temperature prior to a high elongation forming operation. The recrystallized product has a microstructure of grain size of about 5 to 10 micrometers.

The aluminum alloy sheet product of this process has superplastic forming properties that are significantly higher than those produced from the standard AA5083 aluminum alloy composition using the continuous casting process as mentioned above. It is found that the addition of copper, preferably in amounts to about 0.5 to 1% by weight of the magnesium and manganese containing, aluminum alloy significantly increases the formability of the sheet product. This increased level of formability enables the reliable production in volume quantities of hot stretch formed sheet products with regions of relatively large biaxial stretching.

Other objects and advantages of the invention will be apparent from a description of a preferred embodiment which follows.

DESCRIPTION OF A PREFERRED EMBODIMENT

Two aluminum alloy samples were prepared, each having a nominal composition by weight percent shown in the following table.

TABLE 1

| | Mg | Mn | Cr | Cu | Fe | Si | Al |
|---|---|---|---|---|---|---|---|
| Sample 1 | 4.80 | 0.74 | 0.14 | 0.03 | 0.21 | 0.10 | Balance |
| Sample 2 | 4.70 | 0.75 | 0.13 | 0.62 | 0.12 | 0.10 | Balance |

Samples 1 and 2 were both melted and cast in a pilot twin-belt continuous caster operated with the molten metal at a temperature of about 700° C. to produce long 15 millimeter thick by 560 millimeter wide slabs of the alloy material.

The hot cast slabs were immediately hot rolled through a three stand hot rolling mill, in tandem with the caster, to reduce the thickness of the continuously cast slabs and to transform the dendritic as-cast grains to more equi-axed grains, thereby producing hot rolled strips. The hot rolled strips exited the last roller at a temperature of about 300° C. and a thickness of 4 mm. The hot rolled strips experienced a reduction in thickness of about 73% each with respect to the thickness of the prior cast slabs. Of course, the strips grew in length, as well as slightly in width. The continuously produced hot strips were coiled as they exited the rolling mill. The coils were transferred to an annealing furnace and homogenized at a temperature of about 540° C. for 10 hours. The annealed coils were then allowed to cool to ambient temperature.

The coils were edge-trimmed to 380 millimeters in width to suit the width of the available cold rolling mill. The coils were then cold rolled in 3 to 4 passes to 1.0 millimeters in thickness, a net thickness reduction of 75%.

Dog bone shaped tensile specimens were cut from the cold rolled sheet alloys, and tested under the typical superplastic tensile test conditions used for this particular alloy composition. A separate recrystallization heat treatment was not given to the specimens. Instead the specimens recrystallized during heating to the test temperature of 500° C. The specimens were pulled to failure at a speed equivalent to an initial strain rate of $10^{-3}$ $s^{-1}$. Tensile elongation was measured from the length of the failed specimen. Average elongation values were computed by averaging elongation results from five identical tests on each alloy sheet. Comparison of elongation results showed that Sample 2, the copper modified AA5083 continuously cast alloy, gave a much higher average elongation of 379% compared to elongation of 284% obtained with Sample 1, the base AA5083 continuously cast alloy. These elongation values are considered reproducible within plus or minus ten percent of the reported values. Also, compared to an identical alloy produced by the conventional DC (batch) process, the copper-containing, continuously cast aluminum alloy is less expensive to make.

Thus, the addition of 0.2 to 2% copper to the above specified continuously cast magnesium containing aluminum alloys contributes significantly to the formability of the hot and cold rolled sheet metal. For many of the compositions a copper content of 0.5 to 1 percent of the alloy is sufficient and preferred. The increased formability attributable to the copper content permits the forming of some complex shapes previously unattainable at practical strain rates.

While the invention has been described in terms of a specific embodiment, the scope of the invention is not limited by the illustrative examples.

The invention claimed is:

1. A method of making sheet material of a magnesium containing aluminum alloy for sheet metal forming, said method comprising:

continuously casting a composition consisting essentially, by weight, of 3.5 to 5.5% magnesium, 0.4 to 1.6% manganese, 0 to 0.5% chromium, 0.2 to 2.0% copper and aluminum to form a cast slab with an as-cast gage of about 5 to 35 millimeters;

hot rolling said cast slab through at least one hot roller stand to form a hot rolled strip that emerges from said rolling at a temperature in the range of 200° C. to 350° C. and having experienced a thickness reduction from the cast slab of 30 to 80% with a rolled strip thickness of about 3 to 12 millimeters;

immediately coiling said hot rolled strip;

annealing the coiled strip at 450° C. to 560° C. for 3 to 30 hours to produce a microstructure with dispersed intermetallic particles;

cold rolling said annealed strip through at least one cold rolling stage, without intermediate anneal, to effect a reduction of at least 50% in the thickness of the hot rolled strip and to yield said sheet material; and thereafter heating said cold rolled sheet material to recrystallize it to a microstructure characterized by grains no larger than about 10 micrometers.

2. The method as recited in claim 1 in which said composition contains 4.5 to 5% magnesium.

3. The method as recited in claim 1 in which said composition contains 0.5 to 1% manganese.

4. The method as recited in claim 1 in which said composition contains 0.5 to 1% copper.

5. The method as recited in claim 1 in which said hot rolled strip emerges from said rolling at a temperature in the range of 230° C. to 330° C.

6. The method as recited in claim 1 comprising annealing said coiled strip at 500° C. to 550° C. for 5 to 15 hours.

7. The method as recited in claim 1 comprising cold rolling said annealed strip to effect a reduction of 50 to 90% in the thickness of said hot rolled strip and to form a said sheet material less than 4 millimeters in thickness.

8. The method as recited in claim 1 where said recrystallized sheet material has an elongation of at least 300% in tensile test at 500° C. and a strain rate of $10^{-3}s^{-1}$.

9. A method of making sheet material of an aluminum alloy for sheet metal forming, said method comprising:

continuously casting a composition consisting essentially, by weight, of 4.5 to 5.5% magnesium, 0.5 to 1.0% manganese, 0.05 to 0.3% chromium, 0.5 to 1.% copper, 0 to 0.2% zirconium, and aluminum to form cast slab with an as-cast gage of about 6 to 30 millimeters;

hot rolling said cast slab through at least one hot roller stand to form a hot rolled and hot worked strip that emerges from said rolling at a temperature in the range of 230° C. to 330° C. and having experienced a thickness reduction from the cast slab of 30 to 80% with a rolled strip thickness of about 3 to 12 millimeters;

immediately coiling said hot rolled strip;

annealing the coiled strip at 500° C. to 550° C. for 5 to 15 hours to produce a microstructure with dispersed intermetallic particles;

cold rolling said annealed strip through at least one cold rolling stage, without intermediate anneal, to effect a reduction of at least 50% in the thickness of the hot rolled strip and to yield said sheet material and thereafter heating said cold rolled sheet material to recrystallize it to a microstructure characterized by grains no larger than about 10 micrometers.

10. The method as recited in claim 9 where said recrystallized sheet material has an elongation of at least 300% in tensile test at 500° C. and a strain rate of $10^{-3}s^{-1}$.

* * * * *